United States Patent [19]

George

[11] Patent Number: 4,802,586

[45] Date of Patent: Feb. 7, 1989

[54] HIGH SPEED DUPLICATOR WITH COPY SHEET PREPACKAGED SHIPPING AND LOADING CARTON

[75] Inventor: Clifford L. George, Macedon, N.Y.

[73] Assignee: Xerox Corporation, Stamford, Conn.

[21] Appl. No.: 654,705

[22] Filed: Sep. 27, 1984

[51] Int. Cl.[4] ..... B65D 83/00

[52] U.S. Cl. ..... 206/556; 206/449

[58] Field of Search ..... 206/449, 451, 454, 555, 206/556; 221/33, 36, 41; 229/175, 23 R; 271/144, 145, 161–163, 167, 169

[56] References Cited

U.S. PATENT DOCUMENTS

| | | | |
|---|---|---|---|
| 2,600,927 | 6/1952 | Scoville | 206/57 |
| 2,656,089 | 10/1953 | Fallert et al. | 229/23 R |
| 2,725,172 | 11/1955 | McCullough et al. | 229/16 |
| 2,880,866 | 4/1959 | Van Dyck | 206/83.5 |
| 2,887,263 | 5/1959 | Wright | 229/23 R |
| 3,120,727 | 2/1964 | Ziliox . | |
| 3,360,258 | 12/1967 | Nix | 206/449 |
| 3,367,487 | 2/1968 | Dwyer, Jr. | 206/57 |
| 3,955,671 | 5/1976 | Ockey | 206/44 R |
| 4,091,984 | 5/1978 | McFarland | 229/23 BT |

FOREIGN PATENT DOCUMENTS 0057011 8/1982 European Pat. Off. .

*Primary Examiner*—Jimmy G. Foster

*Attorney, Agent, or Firm*—William A. Henry, II

[57] ABSTRACT

A disposable carton is disclosed which is adapted to hold a stack of copy sheets equivalent to a plurality of reams for a printing machine. The carton is constructed of portions which are sequentially removed to expose the stack and permit the operator to carry the stack to a sheet supply platform without disrupting the stack. A remaining portion of the carton which serves to permit the operator to place the stack upon the platform is adapted to be slideably removed from under the stack thus effecting the loading of the stack in the printing machine preparatory to the sheet feed operation.

6 Claims, 6 Drawing Sheets

11
12
13
15
16
17
18
P

HIGH SPEED DUPLICATOR WITH COPY SHEET PREPACKAGED SHIPPING AND LOADING CARTON

This invention relates to a high productivity reproduction system, or copying machine, having copy sheet supply arrangements involving very large quantities of copy sheets for use in such system.

With the advent of higher speed and more sophisticated copy producing machines, printing presses, and the like, considerations as to how the mass of copy sheet supply can best and most effectively be handled has assumed increasing importance. For high productivity copiers or duplicators, copy sheet supply apparatus utilize supply trays which are adapted to hold three to five and even more reams of copy sheets. This type of copy sheet supply requires the operator to load the paper supply tray with a plurality of prepackaged reams of copy sheets, one ream at a time, thereby necessitating repeatedly shutting down the duplicator for a considerable length of time so as to permit the breaking open of the prepackaged reams and loading of the sheet supply tray with the individually handled reams of sheets. This entailed unpackaging individual reams and placing each ream on the elevator platform for the sheet supply using caution that each ream of sheets is correctly placed on an earlier placed ream. Building up a supply tray holding five or more reams involved time which required machine shutdown and consequently loss of productivity as well as requiring many manipulative steps by the operator to accomplish.

A bulk package of copy sheets is disclosed in U.S. Pat. No. 3,367,487 and is adapted to be placed on the delivery platform of a copier. However, the disclosed carton does not lend itself to be dismantled while on a copier platform which is deeply recessed into the copier. The disclosed carton merely provides the operator with many reams of paper which is placed on the platform, and evidently left there for the dispensing of sheets. The package in such operative position cannot be used in printing machines having a bottom sheet feeder or a top feeder working in conjunction with an upwardly movable elevator. In the latter use, the package would become crushed between the elevator platform and the internal structure of the machine, thereby potentially damaging the machine, and in any event causing sheet jamming.

It is, therefore, the object of the present invention to permit the loading of a very high speed printing machine such as a copier or duplicator with a supply of copy sheets quickly and easily and to eliminate copier shutdown for this purpose.

The present invention includes a copy sheet container adapted for shipping and dispensing and capable of being loaded during assembly and manufacturing with sheets of paper equivalent to a plurality of reams of copy sheets. The container may be applied directly to the sheet supply for a printing machine or as being placed upon the platform of the sheet feeding apparatus for the machine. Means are provided so that the portions of the container which were placed on the platform with the stack can be removed so that the stack and the sheet feeding apparatus are cleared of these portions during operation.

Other objects and advantages will be apparent from the ensuing description and drawings in which.

Figure 1:
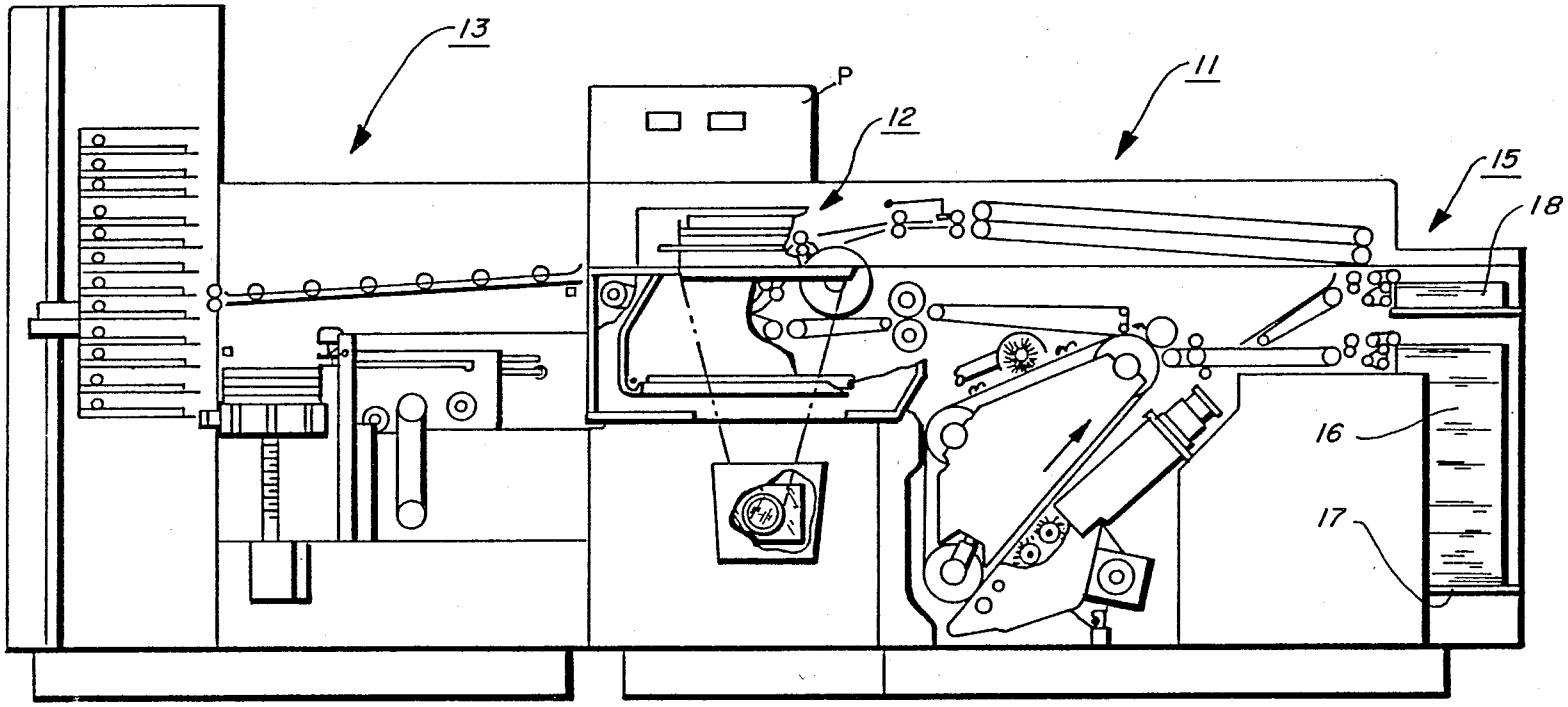
FIG. 1 is a schematic illustration of a configuration of an electrostatographic printing system to which the present invention may be utilized.

For a general understanding of a reproduction machine with which the present invention may be incorporated, reference is made to FIG. 1 wherein components of a typical electrostatic printing system are illustrated. The printing system is preferably of the xerographic type as one including a xerographic processor 11, and a document handling apparatus 12. Preferably, the processor 11 is the same as the processor in the commercial embodiment of the Xerox duplicators, models 9400® and 9500® which utilize flash, full frame exposure, for very high speed production. Similarly, the document handling apparatus 12 is the same as those used in the same machines. It will be understood that most any other type of xerographic processor and multiple exposure document handling apparatus may be utilized. Operating in conjunction with the processor 11 and apparatus 12 is a finishing station 13 and thereby forms the reproduction system shown in FIG. 1. It is understood that any other type of printing machine may incorporate or use the present invention.

The system comprising the processor 11 and the document handling apparatus 12 is under control of a programmer P which permits an operator various options: to turn the entire system ON or OFF; to program the reproduction system for a desired number of reproductions to be made of each original document sheet or set; to select whether simplex or duplex copies are to be made; to select a desired output arrangement, that is, sets mode or stacks mode, stapled or unstapled; to select one of a plurality of paper trays; to condition the machine for the type of document, that is, whether one sided or two sided, to select a copy size reduction mode, and other desirable functions. The programmer P also includes a controller which provides all operational timing and synchronization between the processor 11 and all of its xerographic processing functions, and system control functions, the automatic events to be described hereinafter. The controller may include any suitable microprocessor having a CPU and the appropriate machine clock, but preferably the processor is one similar to the Intel 8080 microprocessor manufactured by the Intel Corporation, Santa Clara, California, and having sufficient ROM's and RAM's for all the necessary functions in the reproduction system.

The copier/duplicator system shown in FIG. 1 is representative of systems which are capable of producing 120 and more image impressions per minute. For simplex or one sided copying, this can result in producing 120 copies per minute or more. In order to accomplish fairly long reproduction runs, the main copy sheet supply subsystem for the system, the main copy sheet holding tray is adapted to hold five reams of sheets. At 500 sheets per ream, five reams totals out to involve 2500 sheets. At a production rate of 120 copies per minute, it can be estimated that five reams will last approximately 21 minutes before needing reloading. For a long run, it can be envisioned that an operator will spend considerable time reloading the main sheet supply tray.

Reloading five reams requires that the copying system be shut down, that each ream must be broken open and the sheets accurately positioned on the tray bottom for the sheet supply tray, which is usually an elevator platform. Generally, these platforms are only inches from the floor and are deeply recessed into the copier housing thus necessitating many cycles of up and down bending and leaning of the operator's body to accomplish a little over 21 minutes of copier use before another cycle of reloading will be required. The present invention is directed to a sheet holding container such as a carton which is particularly suited to be momentarily applied to the sheet supply tray of a copier and be provided with removable sections and a bottom plate upon a relatively large number of copy sheets were previously inserted during manufacturing of the copy sheets. so that upon removal of the sections and the bottom plate, the pre-loaded copy sheets will be exposed upon the supply tray in proper orientation and in a neat stack. It is envisioned in the copier system disclosed herein that 2500 sheets are contained in the carton which together with the sheets were packaged by a copy sheet paper manufacturer as a unitary container of paper much the same as a packaged ream is manufactured.

The sheet holding carton in the present invention may be loaded while the copier is running with the use of an auxiliary sheet supply while 2500 copy sheets can be quickly added.

Figure 2:
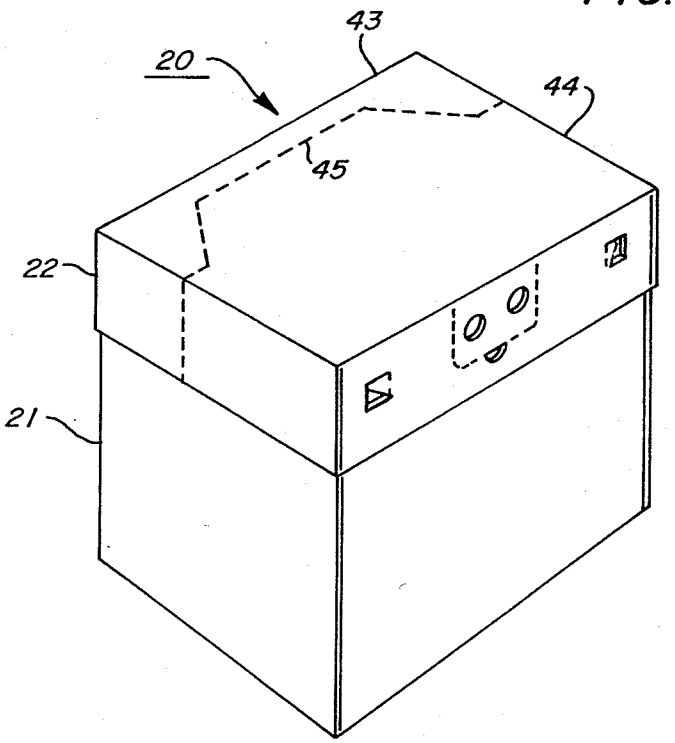
FIG. 2 is an isometric of the shipping and dispensing carton of the present invention.

As shown in FIGS. 1 and 2, the copier/duplicator system 11, 12 and 13 is typically provided with a copy sheet supply station 15 at one end of the system. This station may include a main sheet supply 16 having an elevator platform 17 which serves as the support or holding tray for five or more reams of copy sheets, and an auxiliary tray 18 which may contain one ream. In the conventional manner, as shown in FIG. 2, the main sheet supply includes the elevator platform 17 upon which five or more reams of copy sheets are placed.

The loaded or prepackaged sheet supply carton of the present invention is shown in FIG. 2 and denoted generally by the reference numeral 20. The carton comprises a box or receptacle 21 into which sheets of copy paper are loaded during manufacturing, and as previously stated, the particular illustrated embodiment is adapted to contain 2500 sheets, equivalent to five reams of paper. Upon the box or receptacle 21, a base or top cover 22 is slideably secured as in the manner for the commercial carton which contains ten individually prepackaged reams of paper.

Figure 3:
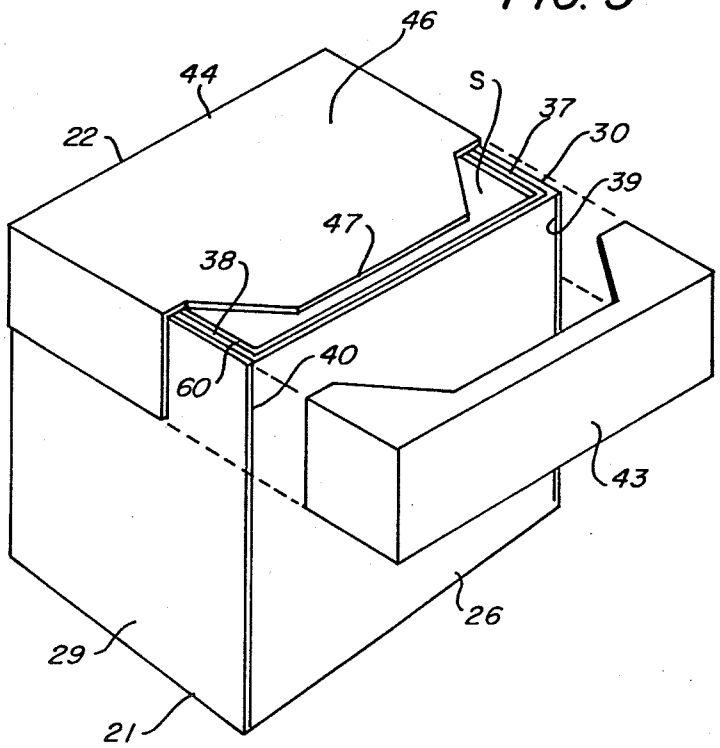
FIGS. 3–5 are isometric views of the carton of the present invention showing various progressive stages of disassembly to expose copy sheets.
Figure 8:
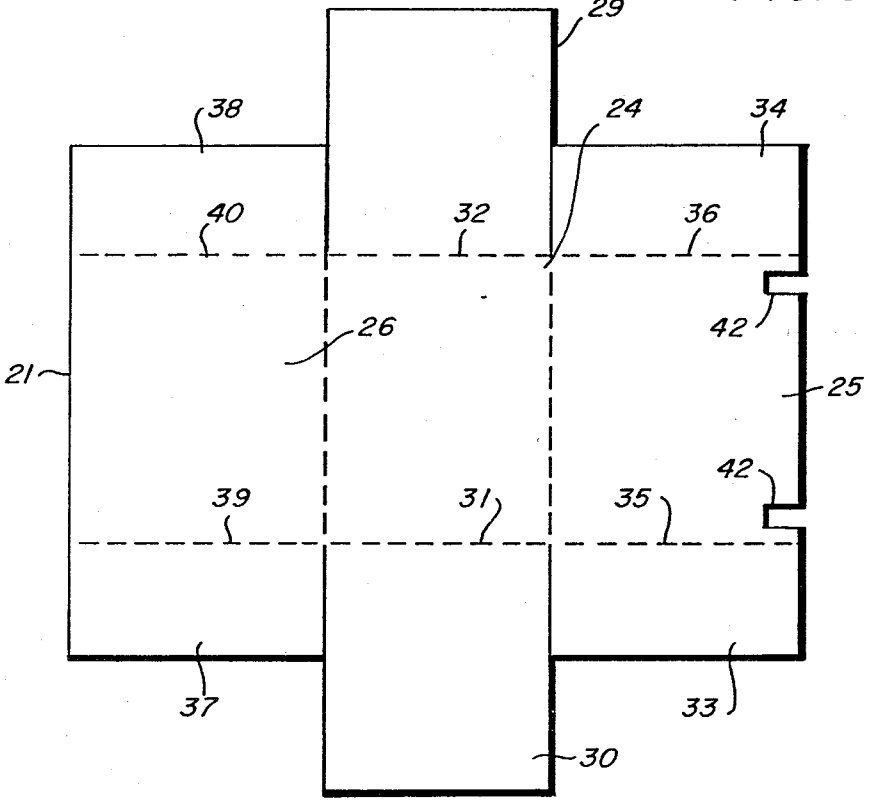

As shown in FIG. 8, the blank for the box or receptacle 21 comprises a bottom panel 24, front and rear panels 25, 26, respectively, which hinges or folds upwardly along fold lines 27, 28 and end panels 29, 30 hinged or folded upwardly along fold lines 31, 32. The front panel 25 is formed with outer flaps 33, 34 which fold inwardly along fold lines 35, 36, respectively when the panel 25 has been folded upwardly. Similarly, the rear panel 26 is provided with flaps 37, 38 foldable inwardly along fold lines 39, 40, respectively. As shown in FIG. 3, during assembly of the box or receptacle 21, the flaps 33, 37 are folded inwardly so that their outer edges abut and are suitably glued to the adjacent inner surface of the side panel 30. Similarly, the flaps 34, 38 are folded inwardly so that their outer edges abut and are glued to the adjacent inner surface of the side panel 29. The front panel 25 is formed with small rectangular-shaped slots 42 spaced from each other nearly the entire width of the panel. These slots are formed in the top edge of the panel 25 for a purpose to be described hereinafter.

Figure 9:
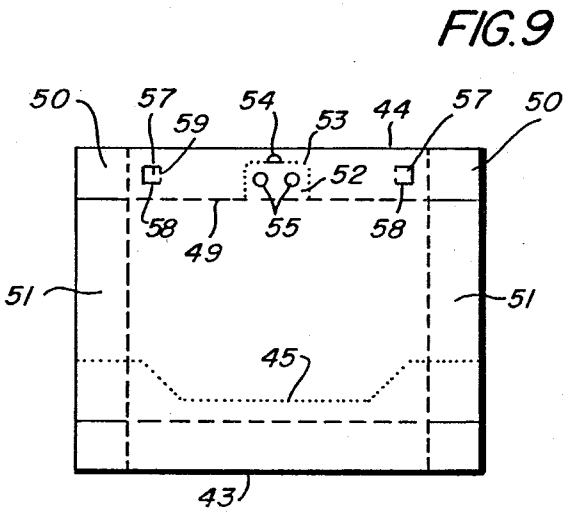
FIGS. 8–10 are diagrammatic views of the blanks from which the carton is formed.
Figure 10:
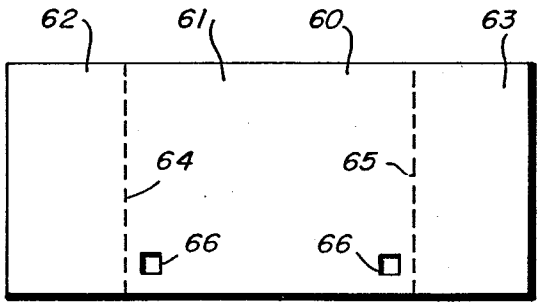

The cover 22 for the carton 20 is formed from a blank shown in FIG. 9 and comprises two sections 43, 44 joined together along a perforated line 45. The sections are separatable by the application of an operator's thumbnail as shown in FIG. 3 when the carton is to be used and conditioned for application to the copier sheet supply platform. Instead of a perforated line 45, a removable tear strip may be utilized to permit separation of the sections 43, 44.

The cover section 44 comprises a top panel 46 having one edge 47 formed along the perforation line 45 after the operator has separated the sections and removed the section 43 leaving the section 44 still upon the base receptacle 21. The edge 47 is shaped to provide a tapered extension of the panel 46 for a substantial area across the opened end of the receptacle 21 to support the sheets within the carton and prevent the same from drooping over the edge 47 of the panel, as will be described below.

Figure 4:
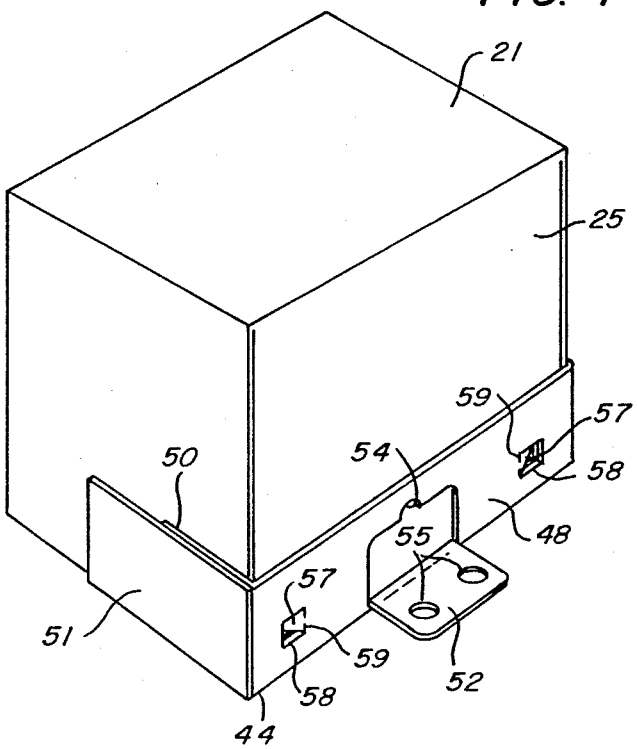

At the opposite side of the section 46 from the edge 47, an end panel 48 is folded down along a fold line 49 and held in this position by a pair of end flaps 50 suitably glued to downwardly extending side panels 51. As shown in FIG. 4, the end panel 48 is formed with a section 52 intermediate the ends thereof and being detachably held in the plane of the panel along a line of perforations 53. Upon application by an operator thumbnail, the section 52 may be detached from its supported relationship with the end panel and be pivoted along the fold line 49 and into the plane of the top panel 46 for a purpose to be described below. To facilitate handling of the section 52 to its folded position, the panel 48 is formed with a cutout 54 to permit the operator to insert a thumbnail and grip the adjacent edge of the section and to pivot the same as aforesaid. Two spaced out holes 55 are formed side-by-side in the section 52 for permitting insertion of operator fingers therein. In the position of the parts shown in FIG. 4, the section 52 serves as a handle.

The end panel 48 of the cover section 44 is also formed with square-shaped tabs 57, each of which is held within the support of a panel along a three-sided perforated line 58 and a fold line 59. The tabs 57 are positioned so as to be opposite the slots 42 formed in end panel 25 of the bar receptacle 21 when the cover 44 is applied to the receptacle as during shipping and storage of the carton.

Figure 6:
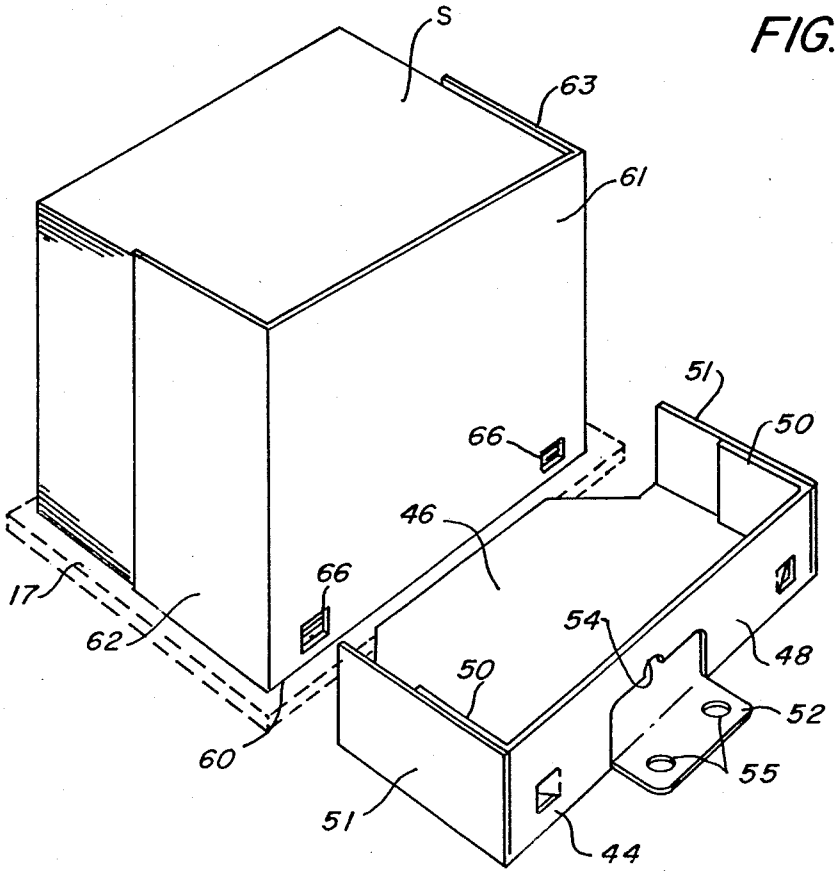
FIGS. 6 and 7 are isometric views of the carton showing the same and a stack of paper being loaded on to the elevator for the system of FIG. 1 and the remaining portions of the carton being removed.
Figure 7:
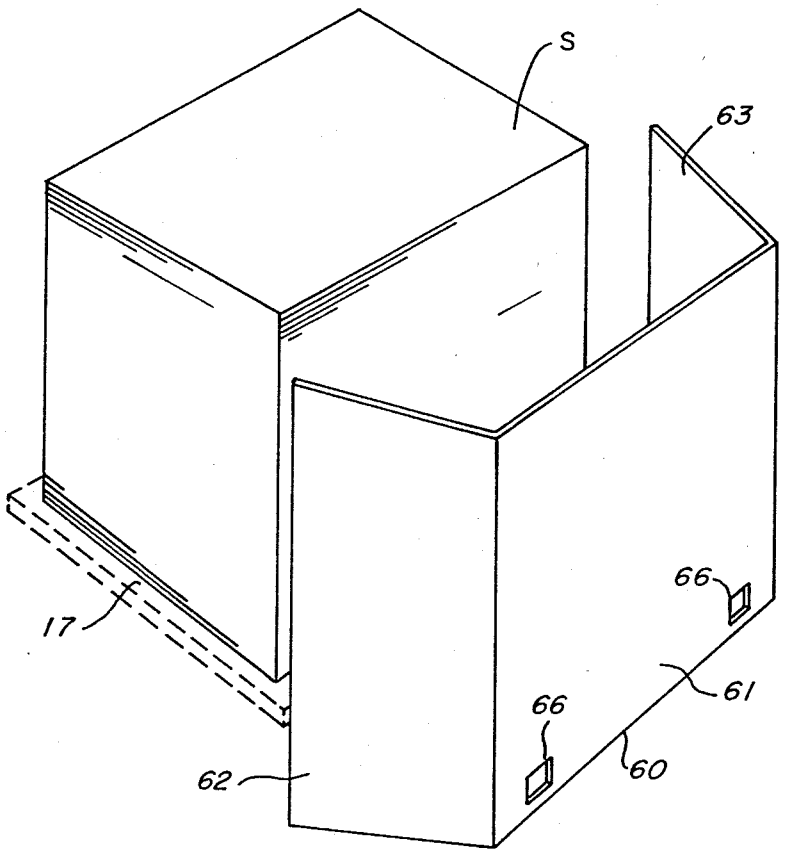

The remaining structure for the carton 20 takes the form of a three-sided insert or wrap section 60 comprising a back panel 61 and two side panels 62, 63 supported thereon and pivotally related thereto along fold lines 64, 65 respectively. Near the lower edge of the insert or section 60, as seen in FIG. 6, a pair of square-shaped, spaced cutouts 66 are formed adjacent the fold lines 64, 65. The slots 66 are positioned, when the carton is fully assembled, to be in alignment with the slots 42 formed in the base receptacle 21 and the tabs 57 formed in the section 44 of the top cover.

Further structural relationships will be discussed below during the description of handling and use of the carton. When fully assembled and preloaded with copy sheets, the carton assumes the following construction. The insert or section 60 is wrapped around and in direct contact with nearly three sides of the stack S. The stack and section 60 are encircled by the box or receptacle 21 being in direct sliding contact with the outer surface of the section. The cover 22, in turn, fits over the open end of the receptacle. In this position of the parts, the panel 25 is placed between the wrap section 60 and the panel 48 of the cover section 44 and the slots 42, the cutouts 66 and the tabs 57 are in alignment.

Figure 5:
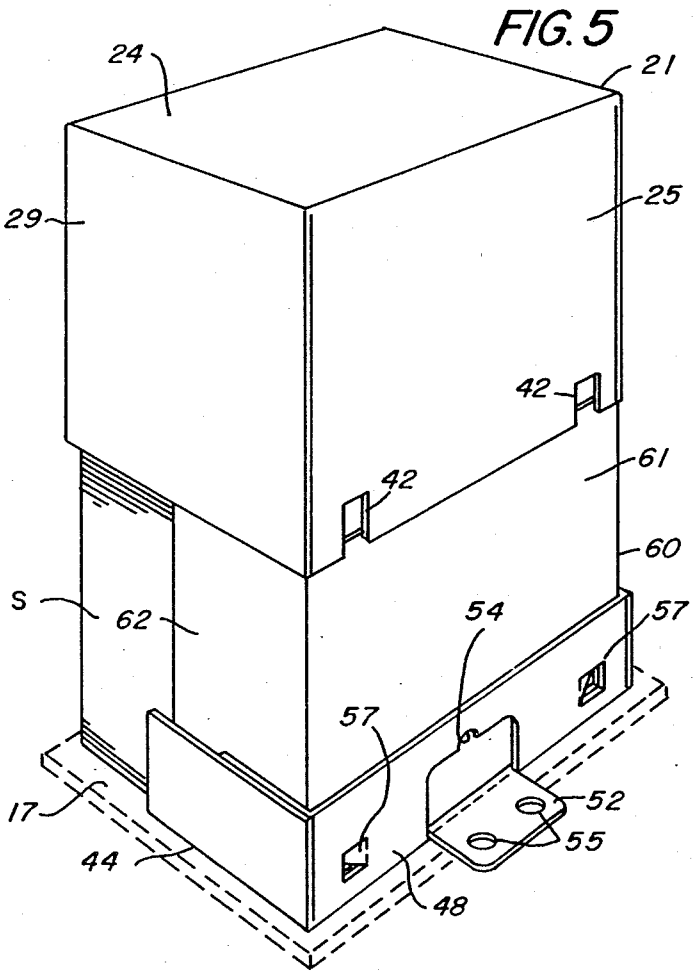

FIG. 2 illustrates the carton 20 as it is handled during shipping and storage. When a need occurs for copy sheets in the processor 11, the operator places the carton on a suitable support such as a table top still in the orientation of FIG. 2. The section 43 of the top cover 22 is removed after complete perforation at the line 45, thus exposing the copy sheet stack S in the carton as shown in FIG. 3. The carton is then inverted on the table top to the orientation shown in FIG. 4. The handle 52 is pivoted to be in the plane of the panel 46 as shown and the tabs 57 are perforated and pushed inwardly by the use of fingers at the paper packaging assembly line. The pushing in of the tabs 57 drives them through the slots 42 in the receptacle 21, and into the cutouts 66 in the section 60. Next, the base receptacle 21 is lifted upwardly from between the wrap section 61 and the cover section 44, as shown in FIG. 5. This removal of the base receptacle from its frictional relationship with the section 60 and the cover panel 48 is possible by the insertion of the tabs 57 within the cutouts 66 formed in the section 60. As the receptacle is lifted, the tabs 57 are cleared because of the open-ended slots 42 while the tabs 57 maintain the section 60 fixed under the weight of the stack S resting upon the panel 46 of the cover section 48.

With the receptacle 21 removed, the operator manually lifts the cover section 44 of the base 22 with the stack S thereon and the wrap section 60 in place, as shown in FIG. 5, onto the platform 17 of the sheet feeding apparatus 15.

After the cover section 44 has been placed upon the platform 17, the operator places a hand against the panel 61 to immobilize the stack S while in coordinated action slowly pulls the stack support section 44 from under the stack S, using the handle 52 with two fingers inserted in holes 55. This coordinated action results in the remaining portions of the carton as shown in FIG. 6. As the section 44 is being pulled, the stack support panel 46 slides between the platform and the bottom sheet of the stack and the tabs 57 are withdrawn from the cutouts 66. After the cover section has been removed, the insert section 60 is removed leaving the stack S upon the platform 17 ready for use by the sheet feeding apparatus.

Other forms of a handle may be utilized in place of the handle 52 for pulling the stack support panel 46 out from under the stack S. For example, a cord or rope attached at its ends to the corners of the section 44 may be used, or other forms made from the carton material. In any event, it is important that the pulling device be in the same plane as the panel 46 so that this panel, rather than the section 44, is being pulled. With the relatively large weight of the stack resting on the panel 46, a pulling force on any other part of the section not in the plane of the stack support panel may deform and collapse the other structure of the carton and place the stack in some disarray.

From the foregoing, it will be appreciated that the present invention provides a quick and easy means for loading large quantities of copy sheets into a sheet feeding apparatus of a printing machine. Particularly significant is the provision of collapsible structural components of a carton which permits this loading in a feeding apparatus which is deeply recessed in the copier structure thus making it difficult to load even at the conventional rate of one ream at a time. The carton has been devised to be easily and quickly loaded with copy sheets at the manufacturer's plant and to be easily and quickly disassembled by the operator during loading.

While the invention has been described to the structure disclosed, it is not confined to the details set forth, but is intended to cover such modifications or changes as may come within the scope of the following claims.

I claim:

1. A disposable carton in combination with a stack of sheets adapted for shipping and storage, and for permitting an operator to present a large stack of sheets for use in a printing machine having a sheet feeding apparatus and a sheet supply platform for supporting copy sheets, comprising, a receptacle having a bottom panel and at least three side panels hingedly connected to said bottom panel along fold lines for supporting the stack of copy sheets therein, said receptacle being open at its top side, a cover section adapted to cover said receptacle and having a top panel bridging substantially across the open top side thereof immediately above the stack of sheets, said cover section having a main section including said top panel and an edge section adapted to be removed during preparation of the carton for loading in the printing machine, said receptacle being adapted to be lifted away and removed from said main section to expose the stack of sheets when the receptacle, the stack, and the main section are inverted, said main section being adapted to be manually positioned upon the platform when the same with the stack have been inverted to place said top panel with the stack supported thereon on top of the platform and with the top of the stack in operating association with the sheet feeding apparatus, and means for permitting the operator to slideably remove said top panel of said main section relative to the platform and the stack and thereby effect the placement of the stack of sheets upon the sheet supply platform.

2. The disposable carton of claim 1 wherein said means for permitting the operator to slideably remove said top panel comprises a manually operable means connected to said top panel.

3. The disposable carton of claim 2 wherein said means for permitting the operator to slideably remove said top panel also includes a back panel positioned against the stack of sheets and being adapted to hold the stack in fixed position when the operator places a hand thereagainst as said top panel is being slideably removed.

4. The disposable carton of claim 1 including means for detachably securing said edge section to said main section.

5. The disposable carton of claim 2 wherein said manually operable means is a handle formed from the material of said main section.

6. A disposable carton in combination with a stack of sheets adapted for shipping and storage, and for permitting an operator to present a large stack of sheets for use in a printing machine having a sheet feeding apparatus and a sheet supply platform for supporting copy sheets, comprising, a receptacle having a bottom panel and at least three side panels hingedly connected to said bottom panel along fold lines for supporting the stack of copy sheets therein, said receptacle being open at its top side, a cover section adapted to cover said receptacle and having a top panel bridging substantially across the open top side thereof immediately above the stack of sheets, said cover section having a main section including said top panel and an edge section adapted to be removed during preparation of the carton for loading in the printing machine, said receptacle being adapted to be lifted away and removed from said main section to expose the stack of sheets when the receptacle, the stack, and the main section are inverted, said main section being adapted to be manually positioned upon the platform when the same with the stack have been inverted to place said top panel with the stack supported thereon on top of the platform and with the top of the stack in operating association with the sheet feeding apparatus, and means for permitting the operator to slideably remove said top panel of said main section relative to the platform and the stack and thereby effect the placement of the stack of sheets upon the sheet supply platform, said manually operable means is planar and is adapted to be folded within the same plane as said top panel.

* * * * *